US007897875B2

(12) United States Patent
Gareis

(10) Patent No.: US 7,897,875 B2
(45) Date of Patent: Mar. 1, 2011

(54) SEPARATOR SPLINE AND CABLES USING SAME

(75) Inventor: Galen M. Gareis, Oxford, OH (US)

(73) Assignee: Belden Inc., St. Louis, MO (US)

( * ) Notice: Subject to any disclaimer, the term of this patent is extended or adjusted under 35 U.S.C. 154(b) by 101 days.

(21) Appl. No.: 12/274,229

(22) Filed: Nov. 19, 2008

(65) Prior Publication Data

US 2009/0173514 A1 Jul. 9, 2009

Related U.S. Application Data

(60) Provisional application No. 60/988,964, filed on Nov. 19, 2007.

(51) Int. Cl.
*H01B 11/02* (2006.01)

(52) U.S. Cl. ..... 174/113 R; 174/113 C

(58) Field of Classification Search ..... 174/113 C, 174/131 A

See application file for complete search history.

(56) References Cited

U.S. PATENT DOCUMENTS

| | | | |
|---|---|---|---|
| 483,285 | A | 9/1892 | Guilleaume |
| 514,952 | A | 2/1894 | Guilleaume |
| 867,659 | A | 10/1907 | Hoopes et al. |
| 1,008,370 | A | 11/1911 | Robillot |
| 1,132,452 | A | 3/1915 | Davis |
| 1,700,606 | A | 1/1929 | Beaver |
| 1,940,917 | A | 12/1933 | Okazaki |
| 1,977,209 | A | 10/1934 | Sargent |
| 1,995,201 | A | 3/1935 | Delon |
| 2,149,772 | A | 3/1939 | Hunter et al. |
| 2,204,737 | A | 6/1940 | Swallow et al. |
| 2,218,830 | A | 10/1940 | Rose et al. |
| 2,501,457 | A | 3/1950 | Thelin |
| 2,538,019 | A | 1/1951 | Lee |
| 3,032,604 | A | 5/1962 | Timmons |
| 3,055,967 | A | 9/1962 | Bondon |
| 3,209,064 | A | 9/1965 | Cutler |
| 3,259,687 | A | 7/1966 | Oatess et al. |
| 3,588,313 | A | 6/1971 | Delves-Broughton |
| 3,603,715 | A | 9/1971 | Ellhardt |

(Continued)

FOREIGN PATENT DOCUMENTS

| | | |
|---|---|---|
| DE | 697378 | 10/1940 |

(Continued)

OTHER PUBLICATIONS

International Search Report, International Application No. PCT/US08/84083, mailed on Jul. 10, 2009, 10 pages.

(Continued)

*Primary Examiner*—Chau N Nguyen
(74) *Attorney, Agent, or Firm*—Lewis, Rice & Fingersh, L.C.

(57) ABSTRACT

A cable, specifically a data cable, which utilizes a T-shaped spline to separate four internal data cables. This cable is a specific form of a more general cable which utilizes a central spline which is designed to separate all but one pair of component cables to provide for material savings in cable construction which still sufficiently reducing cross-talk to meet data cable design specifications.

10 Claims, 3 Drawing Sheets

U.S. PATENT DOCUMENTS

| | | | |
|---|---|---|---|
| 3,610,814 | A | 10/1971 | Peacock |
| 3,621,118 | A | 11/1971 | Bunish |
| 3,644,659 | A | 2/1972 | Campbell |
| 3,819,443 | A | 6/1974 | Simons et al. |
| 3,911,200 | A | 10/1975 | Simons et al. |
| 3,921,378 | A | 11/1975 | Spicer et al. |
| 3,927,247 | A | 12/1975 | Timmons |
| 4,038,489 | A | 7/1977 | Stenson et al. |
| 4,257,675 | A | 3/1981 | Nakagome et al. |
| 4,327,246 | A | 4/1982 | Kincaid |
| 4,361,381 | A | 11/1982 | Williams |
| 4,374,881 | A | 2/1983 | Hamilton |
| 4,385,485 | A | 5/1983 | Yonechi |
| 4,401,366 | A | 8/1983 | Hope |
| 4,446,689 | A | 5/1984 | Hardin et al. |
| 4,447,122 | A | 5/1984 | Sutehall |
| 4,456,331 | A | 6/1984 | Whitehead et al. |
| 4,474,426 | A | 10/1984 | Yataki |
| RE32,225 | E | 8/1986 | Neuroth |
| 4,661,406 | A | 4/1987 | Gruhn et al. |
| 4,683,349 | A | 7/1987 | Takebe |
| 4,710,594 | A | 12/1987 | Walling et al. |
| 4,719,319 | A | 1/1988 | Tighe, Jr. |
| 4,729,409 | A | 3/1988 | Paul |
| 4,755,629 | A | 7/1988 | Beggs et al. |
| 4,778,246 | A | 10/1988 | Carroll |
| 4,784,461 | A | 11/1988 | Abe et al. |
| 4,784,462 | A | 11/1988 | Priaroggia |
| 4,807,962 | A | 2/1989 | Arroyo et al. |
| 5,000,539 | A | 3/1991 | Gareis |
| 5,087,110 | A | 2/1992 | Inagaki et al. |
| 5,132,488 | A | 7/1992 | Tessier et al. |
| 5,149,915 | A | 9/1992 | Brunker et al. |
| 5,162,609 | A | 11/1992 | Adriaenssens et al. |
| 5,177,809 | A | 1/1993 | Zeidler |
| 5,212,350 | A | 5/1993 | Gebs |
| 5,289,556 | A | 2/1994 | Rawlyk et al. |
| 5,305,797 | A | 4/1994 | Roy, Sr. |
| 5,329,064 | A | 7/1994 | Tash et al. |
| 5,355,427 | A | 10/1994 | Gareis et al. |
| 5,444,184 | A | 8/1995 | Hassel |
| 5,486,649 | A | 1/1996 | Gareis |
| 5,557,698 | A | 9/1996 | Gareis et al. |
| 5,574,250 | A | 11/1996 | Hardie et al. |
| 5,670,748 | A | 9/1997 | Gingue et al. |
| 5,696,295 | A | 12/1997 | Wulff et al. |
| 5,699,467 | A | 12/1997 | Kojima et al. |
| 5,763,823 | A | 6/1998 | Siekierka et al. |
| 5,789,711 | A | 8/1998 | Gareis et al. |
| 5,883,334 | A | 3/1999 | Newmoyer et al. |
| 5,952,615 | A | 9/1999 | Prudhon |
| 5,969,295 | A | 10/1999 | Boucino et al. |
| 6,074,503 | A | 6/2000 | Clark et al. |
| 6,091,025 | A | 7/2000 | Cotter et al. |
| 6,099,345 | A | 8/2000 | Milner et al. |
| 6,140,587 | A | 10/2000 | Sackett |
| 6,150,612 | A | 11/2000 | Grandy et al. |
| 6,162,992 | A | 12/2000 | Clark et al. |
| 6,222,130 | B1 | 4/2001 | Gareis et al. |
| 6,248,954 | B1 | 6/2001 | Clark et al. |
| 6,288,340 | B1 | 9/2001 | Arnould |
| 6,297,454 | B1 | 10/2001 | Gareis |
| 6,300,573 | B1 | 10/2001 | Horie et al. |
| 6,303,867 | B1 | 10/2001 | Clark et al. |
| 6,310,295 | B1 | 10/2001 | Despard |
| 6,365,836 | B1 | 4/2002 | Blouin et al. |
| 6,506,976 | B1 | 1/2003 | Neveux, Jr. |
| 6,596,944 | B1 | 7/2003 | Clark et al. |
| 6,624,359 | B2 | 9/2003 | Bahlmann et al. |
| 6,639,152 | B2 | 10/2003 | Glew et al. |
| 6,686,537 | B1 | 2/2004 | Gareis et al. |
| 6,687,437 | B1 | 2/2004 | Starnes et al. |
| 6,770,819 | B2 | 8/2004 | Patel |
| 6,787,697 | B2 | 9/2004 | Stipes et al. |
| 6,800,811 | B1 | 10/2004 | Boucino |
| 6,815,611 | B1 | 11/2004 | Gareis |
| 6,818,832 | B2 | 11/2004 | Hopkinson et al. |
| 6,855,889 | B2 | 2/2005 | Gareis |
| 6,888,070 | B1 | 5/2005 | Prescott |
| 6,897,382 | B2 | 5/2005 | Hager et al. |
| 6,974,913 | B2 | 12/2005 | Bahlmann et al. |
| 6,998,537 | B2 | 2/2006 | Clark et al. |
| 7,049,523 | B2 | 5/2006 | Shuman et al. |
| 7,064,277 | B1 | 6/2006 | Lique et al. |
| 7,109,424 | B2 | 9/2006 | Nordin et al. |
| 7,135,641 | B2 | 11/2006 | Clark |
| 7,145,080 | B1 | 12/2006 | Boisvert et al. |
| 7,154,043 | B2 | 12/2006 | Clark |
| 7,196,271 | B2 | 3/2007 | Cornibert et al. |
| 7,208,683 | B2 | 4/2007 | Clark |
| 7,214,884 | B2 | 5/2007 | Kenny et al. |
| 7,238,885 | B2 | 7/2007 | Lique et al. |
| 7,244,893 | B2 | 7/2007 | Clark |
| 7,339,116 | B2 | 3/2008 | Gareis et al. |
| 7,358,436 | B2 | 4/2008 | Dellagala et al. |
| 7,405,360 | B2 | 7/2008 | Clark et al. |
| 7,534,964 | B2 | 5/2009 | Clark et al. |
| 2003/0230427 | A1 | 12/2003 | Gareis |
| 2004/0050578 | A1 | 3/2004 | Hudson |
| 2005/0029007 | A1 | 2/2005 | Nordin et al. |
| 2006/0131058 | A1 | 6/2006 | Lique et al. |
| 2006/0243477 | A1 | 11/2006 | Jean et al. |
| 2007/0209823 | A1 | 9/2007 | Vexler et al. |
| 2008/0041609 | A1 | 2/2008 | Gareis et al. |
| 2008/0164049 | A1 | 7/2008 | Vexler et al. |
| 2009/0133895 | A1 | 5/2009 | Allen |

FOREIGN PATENT DOCUMENTS

| | | | | |
|---|---|---|---|---|
| DE | 24 59 844 | A1 | | 7/1976 |
| EP | 1 107 262 | A2 | | 6/2000 |
| EP | 1 085 530 | A2 | | 3/2001 |
| EP | 1 162 632 | A2 | | 12/2001 |
| GB | 342606 | | | 2/1931 |
| JP | 1942-10582 | | | 9/1942 |
| JP | SHO56-1981-7307 | | | 1/1981 |
| JP | SHO56-1981-8011 | | | 1/1981 |
| JP | SHO56-1986-13507 | | | 1/1986 |
| JP | 4-332406 | A | | 11/1992 |
| JP | 5-101711 | A | | 4/1993 |
| JP | 2004-311120 | | * | 11/2004 |
| SU | 1343447 | A1 | | 10/1987 |
| WO | 9624143 | A1 | | 8/1996 |
| WO | 9848430 | A1 | | 10/1998 |
| WO | 0051142 | A1 | | 8/2000 |
| WO | 0079545 | A1 | | 12/2000 |
| WO | 0108167 | A1 | | 2/2001 |
| WO | 0154142 | A1 | | 7/2001 |
| WO | 03077265 | A1 | | 9/2003 |
| WO | 03094178 | A1 | | 11/2003 |
| WO | 2005048274 | A2 | | 5/2005 |

OTHER PUBLICATIONS

Bell Communications Research, Inc., "General Requirements for Optical Fiber and Optical Fiber Cable," Technical Advisory TA-TSY-000020, Aug. 1986, 77 pages, Issue 5.

Hawley, G.G., "The Condensed Chemical Dictionary," 1981, 5 pages, Tenth Edition, Van Nostrand Reinhold Company.

Refi, J.J., "Fiber Optic Cable—A LightGuide," abc TeleTraining, Inc., 1981, 4 pages.

C&M Corporation, "Engineering Design Guide," 1992, 3 pages, Third Edition.

* cited by examiner

SEPARATOR SPLINE AND CABLES USING SAME

CROSS REFERENCE TO RELATED APPLICATIONS

This application claims the benefit of U.S. Provisional Application No. 60/988,964, filed Nov. 19, 2007, the entire disclosure of which is incorporated herein by reference.

BACKGROUND OF THE INVENTION

1. Field of the Invention

This disclosure relates to the field of electronic cables. In particular, to high speed data cables (category or premise cables) and other cables that utilize fillers or splines.

2. Description of Related Art

Electronic devices, and computers in particular, are starting to become ever more connected. Just 20 years ago the idea of a computer network where machines talked with each other was simply a dream. Streaming media, more intense graphics, and interactive web-based systems are increasingly demanding of speed in network transfer. Today, people from around the world are connected to computer networks which are both local (such as LANs) and worldwide in scope (such as the Internet).

As computers have become increasingly interconnected, there has arisen a more pronounced need for the cables and connectors used to connect them to be able to transfer more information in the same amount of time. While wireless networks have attracted a lot of attention recently, the vast majority of networks, and particularly of high speed networks, still communicate by sending electrical signals across conductors wired between them and therefore, as the networks push to be faster, the cables need to adapt to allow faster communication.

One particularly useful type of cable in the computer networking arena are the so-called "category" cables of which category 6 (or CAT6) is currently one of the standards utilized with category 5 or 5e (CAT5, CAT5e) also being used on a fairly regular basis. In category cable, it is necessary to meet certain performance characteristics set by a standards setting organization (such as the TIA, ISO, or IEEE) for critical performance attributes such as near-end cross-talk (NEXT), cross-talk ratio (ACR), Equal Level Far End Crosstalk (ELFEXT), and the like. Generally, the higher the number of the cable, the more rigorous the requirements and the faster communication the cable is designed for. These standards are set so that networks utilizing the cable can operate and transfer at particular speeds without suffering from loss of data or other problematic concerns. In many respects, the standard defines the label. A CAT6 cable meets certain performance characteristics and therefore can be called "CAT6." That cable can then also be utilized in a network requiring the specific speed of the standard.

The exacting standards required for data speed and electrical characteristics of CAT6 or higher cable relate in many cases to cross-talk in the cable. This includes NEXT and special categories such as far-end cross-talk (FEXT), and Power Sum NEXT (PSNEXT). Cross-talk is the interference in one channel from an adjacent channel and, in particular, relates to the cross-talk or signal interference between two component cables or wire pairs. Category cables generally utilize four component cables each of which is formed of a twisted pair. Each twisted pair comprises two individual conductors or wires (generally insulated from each other) which are twisted about each other to form a generally double helix shape. Over a length of the component cable, the shape of the twisted pair approaches a cylindrical shape.

Each of these component cables, and any other components included in the cable, are then generally encased in a jacket which forms the resultant cable. Cross-talk occurs when electrical impulses from one component cable (wire pair) can migrate to a different wire pair within this cable. That is, the component cables "talk" in a manner that is undesirable by sharing signals or allowing signals to finish propagating in a component other than the one in which they began propagating. Cross-talk can serve to corrupt data, and in high-speed networks, can cause the network to slow. Cross-talk is a significant concern in trying to build category cable because digital data which is propagated incorrectly can be misunderstood when received and therefore has to be re-sent and/or ignored. The problem is particularly acute in CAT6 cables where, in its optimal format, all four twisted pairs (component cables) are utilized for data transmission.

In many early cable designs, the insulation on each wire in the twisted pair was sufficient to prevent cross-talk between the component cables. Higher standards are generally too rigorous, however, for this limited prevention and it is desirable to further insulate the twisted pairs from each other. This insulation may be performed by physical separation. In most cases, however, the separation cannot be maintained within the resultant cable without additional structure and a physical barrier is necessary.

Previously, twisted pair data cables (category cables) have tried to meet the requirements by using "X", "+", or other cross-shaped fillers (or splines as they are sometimes called) which are placed within the cable jacket to separate the twisted pairs from each other. These designs all have the same general layout. There are four twisted-pairs included in the cable which are arranged about the central filler. Each twisted pair is placed in a single "V" formed by two-legs of the cross, placing the material of the filler between each twisted pair. In effect, the two neighboring twisted pairs are separated by a leg of the filler. The filler material (which is generally insulative) then serves to inhibit cross-talk between the different twisted pairs One such cross-shaped filler is described in U.S. Pat. No. 6,297,454, the entire disclosure of which is herein incorporated by reference.

While these fillers have helped improve cross-talk characteristics, they are not necessarily ideal in all situations. Cross-shaped fillers keep the twisted pairs separated by some of the filler material, even when compressed, but often do so at the expense of over-correction. A cross-shaped filler inhibits motion of the component cables and the cross talk between them by placing a physical barrier between each of the component cables. This barrier prevents cross-talk by keeping each pair of component cables separated by the barrier of the material of the spline. However, this physical barrier can be unnecessary with regards to certain of the pairs for the prevention of certain levels of cross talk.

The inclusion of unnecessary material to form the cross-shaped spline for cables designed to meet these standards therefore can make the cross-shaped construction both more expensive and more difficult to manufacture without it being really necessary. Further, because of the excess material within the cable, the resulting cable can have an increased fire risk and is generally more rigid and physically larger in construction than may be necessary. These characteristics can make the cable less useful and harder to work with.

It is therefore desired in the art to have a spline which can provide for inhibition to cross talk between component cables so as to produce cables suitable for meeting certain data transfer requirements, without having to have the expense or manufacturing difficulty of a filler that places unnecessary physical barrier between adjoining component cables when such physical barrier is unnecessary to inhibit the cross talk sufficiently to meet the standard. Alternatively, the removed material can be repositioned in the spline to enhance overall performance at the same general cost.

SUMMARY OF THE INVENTION

For these and other reasons there are described herein multi-part cables, methods of constructing multi-part cables, and other related systems, networks, and structures for forming cables, such as but not limited to, category cables (e.g., CAT6 cable) or other data cables, which include a separator spline or filler. This will generally be in the form of a T-shaped filler for a standard cable configuration including four twisted pair component cables. The T-shaped filler provides for a spline which provides physical separation where it is most needed in a four pair cable, while eliminating a leg from a more traditional X-shaped spline for the least needed material separation portion to provide for material savings in the spline's construction and generally provide a cable which can utilize less material, may be easier to construct and use, and still meets desired data transmission standards.

Described herein, in an embodiment, is a multi-part cable such as, but not limited to a category (e.g. CAT5, CAT5e, CAT6, or higher) data cable, comprising: a number of component cables, the number of component cables being equal to or greater than three; and a T-shaped spline having a longitudinal axis extending along the longitudinal axis of the cable; wherein the spline comprises a main beam and an auxiliary beam which extends from one side of the main beam at or about the center of the main beam, and generally has a latitudinal dimension about one half the dimension of the main beam. In an embodiment where four component cables are present, the T-shaped spline serves to form a physical barrier between all but a single pair of the component cables. Depending on embodiment, this unseparated pair may be any of the pairs, but is often the pair comprising the shortest lay (S1) and shortest long lay (L1) component cables.

In an embodiment, each of the component cables comprises a twisted pair of insulated conductors which may be twisted into a double helix.

In an embodiment, the multi-part cable may further include a jacket enclosing the surfaced filler and the component cables and/or a shield which may enclose the surfaced filler and the component cables, the shield being enclosed by the jacket or not.

Disclosed herein, among other things, are multi-part cables such as category 5, 5e or 6 (CAT5, CAT5e or CAT6) cables or other data cable designs which include multiple component cables and a T-shaped spline within a single jacket. In particular, each of these multi-part cables generally comprises at least two twisted pair data cables each of which is formed of two intertwined (generally as a double helix), individually insulated conductors (and possibly an external shield) and a T-shaped filler having a generally T-shaped cross sectional shape. In an embodiment, the T-shape is formed by the removal of one arm of an otherwise regular "plus-sign" (+) shape having arms of equal length.

There is described herein, among other things, a multi-part cable comprising: at least three component cables; and a T-shaped spline having a longitudinal axis extending along the longitudinal axis of the cable; the spline comprising: a main beam, and an auxiliary beam which extends from one side of the main beam at or about the center of the main beam, and generally has a latitudinal dimension about one half the dimension of the main beam.

In an embodiment of the cable the at least three component cables comprises at least four component cables.

In an embodiment of the cable the T-shaped spline serves to form a physical barrier between all but a single pair of the component cables which may be the shortest lay (S1) and shortest long lay (L1) component cables.

In an embodiment of the able the cable meets the criteria set out by one of the standards selected from the group of standards consisting of: category 5, category 5e, and category 6.

In another embodiment of the cable each of the component cables comprises a twisted pair of insulated conductors which may be twisted into a double helix In another embodiment the cable also comprises an insulative jacket enclosing the T-shaped filler and the component cables.

In another embodiment the cable also comprises a shield which encloses the T-shaped filler and the component cables which may in turn be enclosed by an insulative jacket.

There is also described herein a multi-part cable comprising: four twisted pail data cables each of which is formed of two intertwined individually insulated conductors having a longitudinal axis; a T-shaped filler having a generally T-shaped cross-sectional shape with three arms and a longitudinal axis; and an insulative jacket enclosing the data cables and the T-shaped filler along their longitudinal axes; wherein two of the at least four cables are not separated by an arm of the T-shaped filler.

In an embodiment of the cable the two cables not separated by an arm of the T-shaped filler comprise the shortest lay (S1) and shortest long lay (L1) twisted pair data cables.

In another embodiment of the cable the cable meets the criteria set out by one of the standards selected from the group of standards consisting of category 5, category 5e, and category 6.

There is also described herein a multi-part cable comprising: at least three component cables; and a spline having a longitudinal axis extending along the longitudinal axis of the cable; the spline comprising: a central beam having a longitudinal dimension and a latitudinal dimension; and a plurality of arms each of which extends from the central beam along the latitudinal dimension in a radial fashion and extends the longitudinal dimension of the central beam; wherein, there is one fewer arm in the plurality of arms than there are component cables.

There is also described herein a multi-part cable comprising: at least three component cables; and a spline having a longitudinal axis extending along the longitudinal axis of the cable; the spline comprising: a central beam having a longitudinal dimension and a latitudinal dimension; and a plurality of arms each of which extends from the central beam along the latitudinal dimension in a radial fashion and extends the longitudinal dimension of the central beam; wherein the arms are arranged to have angles between them; one of the angles being about double each of the other angles, which are about the same.

There is also described herein a collected cable comprising: a plurality of multi-part cables, each of the multi-part cables comprising: at least three component cables; and a T-shaped spline having a longitudinal axis extending along the longitudinal axis of the cable; the spline comprising: a main beam; and an auxiliary beam which extends from one side of the main beam at or about the center of the main beam, and generally has a latitudinal dimension about one half the dimension of the main beam.

DESCRIPTION OF THE PREFERRED EMBODIMENT(S)

Figure 1:
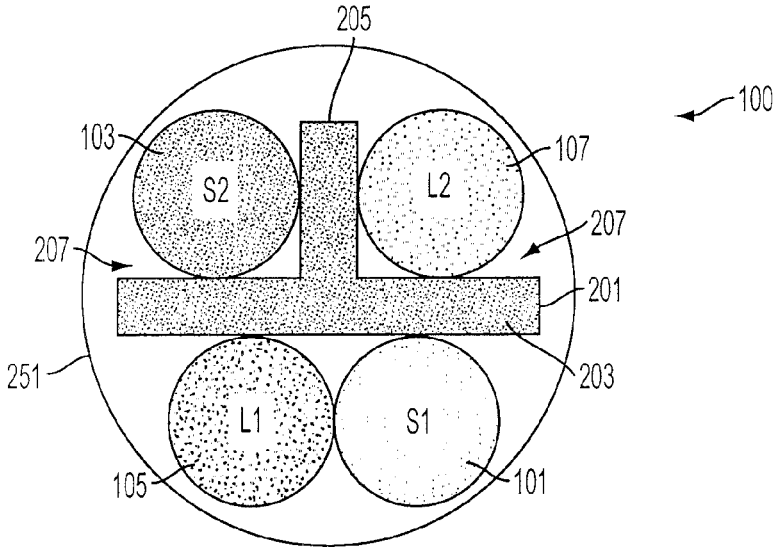
FIG. 1 Provides a conceptual cut-through view of a data cable including a T-shaped spline.
Figure 4:
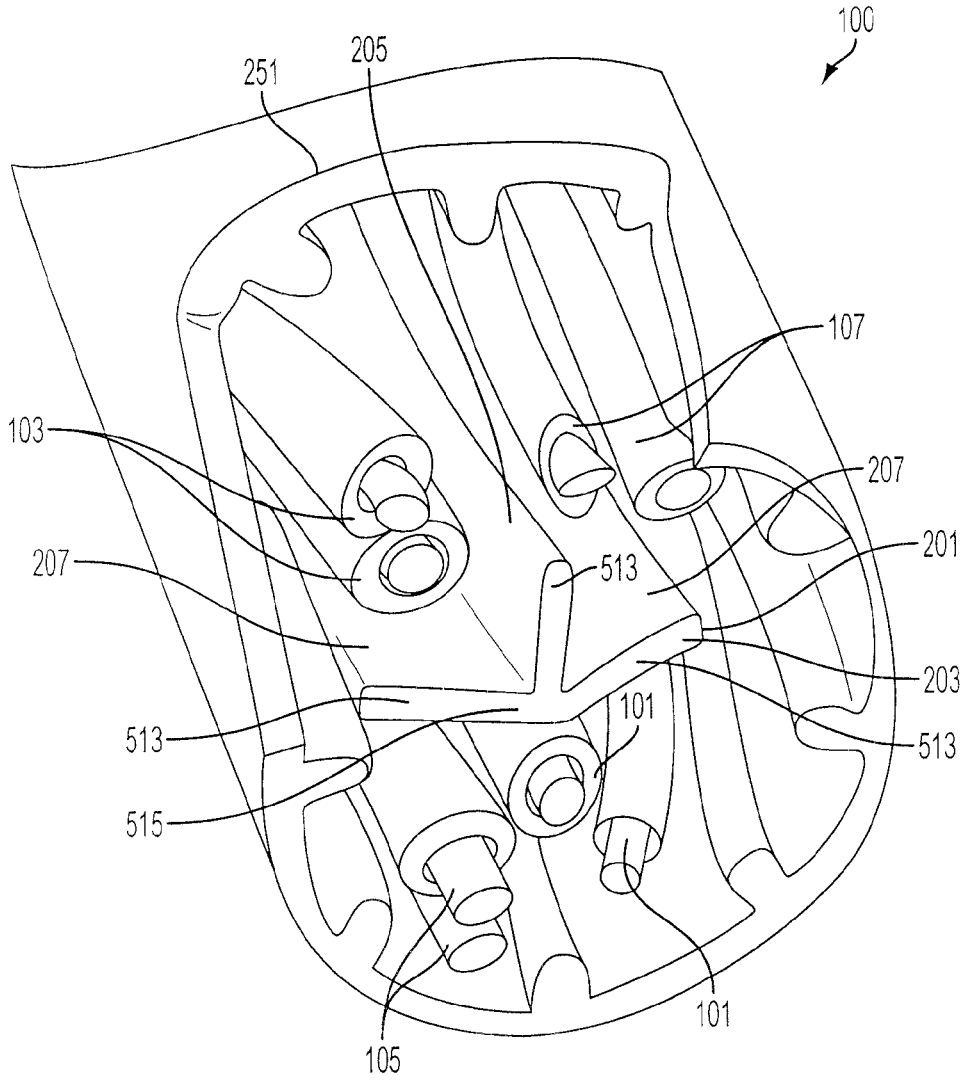
FIG. 4 provides a perspective view of an embodiment of a data-cable including a T-shaped spline.

FIG. 1 shows a cross-sectional representative view of an embodiment of a cable (100) including a T-shaped spline (201). This view is taken along the plane of the latitudinal dimension of the cable showing a cross section across the longitudinal dimension which extends into and out of the sheet. The cable comprises four component cables (101), (103), (105), and (107). In this conceptual cross-section, these component cables (101), (103), (105), and (107) are indicated by circles to show the general area taken up by each cable as is conventional in illustrations in the industry. FIG. 4 provides for a perspective view of an embodiment of a cable showing a more realistic example of each twisted pairs' layout. These component cables (101), (103), (105), and (107) will generally comprise two individually insulated conductors, which are wrapped around each other in a generally helical construction to provide for a twisted-pair data cable.

The four component cables (101), (103), (105) and (107) are also marked in FIG. 1 to indicate their lay. Cable S1 is the shortest lay cable (101), cable S2 is the longest short lay cable (103) (that is, has the second shortest lay length), cable L1 is the shortest long lay cable (105) (That is has the second longest lay length), and cable L2 is the longest lay cable (107). The cables will generally be referred to by their lay throughout this disclosure as the cable can obviously be rotated in physical space without altering the arrangement of the internal component cables. The cable (100) further includes a T-shaped spline (201) and an outer jacket (251) which surrounds the spline (201) and the component cables (101), (103), (105), and (107).

The outer jacket (251) can be designed to be an insulative enclosure, as is common in most types of cable, being made from rubber, plastic, or similar materials. Alternatively, the jacket may be metallic or otherwise conductive. This latter option is often used in a so-called "armored" cable construction. In a still further embodiment, multiple outer jackets (251) may be used in a single cable. Specifically, there may be an inner conductive jacket which is in turn enclosed by an outer insulative jacket. Still further, a wrap which does not necessarily enclose the internal components (for example, a thin wire helically wrapped about the spline and data cables) may be used in conjunction with an outer jacket.

The inclusion of the T-shaped spline (201) generally allows for cross pair ratios to be reduced and increase the adjacent pair ratios for improved NEXT, lower skew (min to max lay difference is reduced), and better Alien Near End Crosstalk (ANEXT) (shorter lays).

The use of the T-shaped spline (201) allows for improved spacing of pairs for improved Transverse Conversion Loss (TCL), while maintaining more uniform NEXT and other internal electricals, generally with less filler material usage. Specifically, since the spline (201) utilizes fewer arms than a more standard "X" shaped spline, the spline can be made of similar size using only ¾ as much material as an "X" shaped spline. Alternatively, material from the "missing" arm may be redistributed to other parts of the spline to potentially provide improved characteristics through such redistribution.

In principle, the longer lay S2 (103) and L2 (107) pairs generally need physical separation, as do adjacent pairs in order to provide for sufficient NEXT. The shorter lay length S1 and L1 pairs generally have an inherent advantage on NEXT and do not generally require the physical separation of the adjacent and longer lay cross-pair combinations.

The spline (201) in FIG. 1 is therefore designed to provide physical separation for all the pairs except the S1 (101) and L1 (105) pairs which may not require such separation because of their inherent advantage. The spline (201), therefore is arranged to have a longitudinal length extending the length of the cable and a "T-Shaped" cross section as shown in FIG. 1. The "T" shape is created from the spline (201) having a main beam (203) and an auxiliary beam (205). The main beam (203) is latitudinally sized so as to extend between two sets of two adjacent pairs. In the embodiment of FIG. 1, the L1 (105) and S1 (101) pair and the S2 (103) and L2 (107) pair. The auxiliary beam (205) then extends from the generally central location of the main beam (203) to separate the S2 (103) and L2 (107) pair. There is no portion of the spline (201) which separates the L1 (105) and S1 (101) pair in this embodiment.

In order to provide for the separation in a controlled form, the main beam (203) generally has about twice the latitudinal dimension as the auxiliary beam (205) which therefore provides for two "v" shaped openings having relatively similar dimensions as shown in FIG. 1. In effect, the T-filler (201) can also be thought of as an "X" or "+" shaped spline missing one arm, the arm being the one that would normally separate the L1 (105) and S1 (101) component cable pair and thus creating the "T" shape of the cross section of the spline (201).

In order to further improve performance of the cable with a T-shaped spline, in an embodiment, the specific lay lengths of various of the component cables may also be altered slightly to allow for additional inherent advantage. In an embodiment, the L1 (105) and S1 (101) component cables, either individually or together, have a lay length altered from what would traditionally be used if a cross-shaped spline was present to improve their NEXT with each other. Even if such a change made cross talk between other components more likely, the physical separation of those components will generally still be more than enough to inhibit the cross talk to a desirable level while allowing use of the T-spline (201) and appropriate savings on materials.

While the embodiment of FIG. 1 provides for a preferred layout of the various lay component cables (101), (103), (105) and (107) relative to the spline (201), it should be recognized that in alternative embodiments, the two cables not separated by a leg of the spline (201) can be any two of the component cables. FIG. 2 provides for such an indication of how such a spline (201) may appear positioned so as to provide for alternative arrangements by not separating different component cable pairs.

Figure 2A:
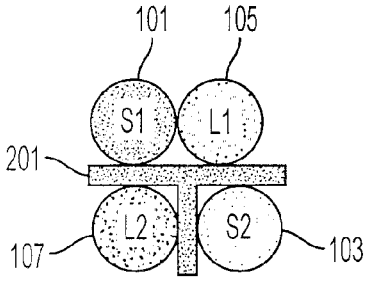
FIG. 2 provides conceptual cut-through views of alternative arrangements of a T-shaped spline in data cables.
Figure 2B:
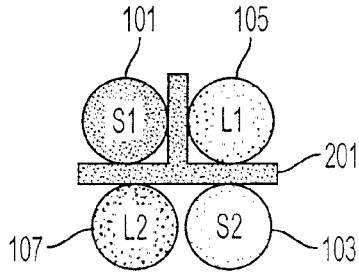
Figure 2C:
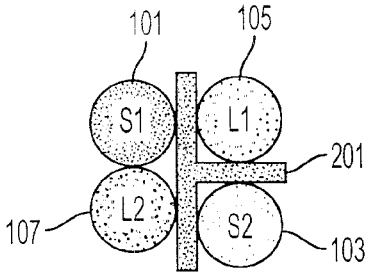
Figure 2D:
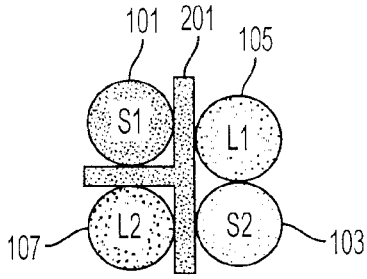

Specifically, FIG. 2A shows S1 (101) and L1 (105) not separated, as in FIG. 1, FIG. 2B shows S2 (103) and L2 (107) not separated, FIG. 2C shows S1 (101) and L2 (107) not separated, and FIG. 2D shows S2 (103) and L1 (105) not separated. Note that the diagonal pairs L1 (105) and L2 (107) and S1 (101) and S2 (103) are separated by the T-shaped spline (201) in all the embodiments of FIG. 2. In effect, the spline (201), therefore, serves to provide for five optimizations and one non-optimized arrangement between the component cables (101), (103), (105) and (107) in all these embodiments of FIG. 2. The non-optimized arrangement may be selected for particular purpose (and specifications) of the cable (100). In an embodiment, this selection is because the cable is designed to be collected with other cables in a collected cable and the optimizations are internally chosen to reduce materials necessary to produce the spline while still allowing the collected cable to meet the specifications of operation desired.

One of ordinary skill in the art would understand that although the embodiments discussed herein are designed specifically for use with component cables which are constructed of three or four twisted pair conductors (such as CAT5, CAT5e, CAT6, or higher cables), the same principles, methods, and designs could be incorporated into other cables incorporating any number of twisted pairs (such as, but not limited to, any type of enhanced data cables) and/or cables utilizing component cables that are not in a twisted pair configuration and/or cables utilizing components which are not cables at all. Specifically, in alternative embodiments, the filler would not necessarily be T-shaped, but would provide for a situation where it simply has one fewer arm than there are component cables present and the place where the arm is missing would effectively be a space which is double the size of the spaces provided by the arms which are present.

In an embodiment of this arrangement, the structure of the spline can be described as having a plurality of arms (513) about a central beam (515) or other central axis The angle between all but one pair of the arms is generally the same, and the angle between the last remaining pair is generally double that angle. Alternatively, the arrangement is such that the number of cables is one fewer than the number of arms (513) which are arranged about the central beam (515). In the T-shaped spline therefore, there are effectively three pairs Two are at about 90 degree angles and the remaining would be at about 180 degrees. If there was four arms, there would effectively be four angles, 3 of which are about 72 degrees, while the fourth is about 144 degrees. Thus the T shaped spline (201) is basically a general layout of which the "T" is a specific option when 4 cables (the most common arrangement) are used.

One should also recognize that while the T-shaped spline as discussed above is designed to be used with one more component cable than there are arms on the spline, in an alternative embodiment, the spline may be used with fewer component cables. This will generally be because the cable will be combined with other cables into a collected cable, but that is not necessary. Further, the principles and inventions disclosed herein may also be utilized on cables developed to meet new standards (such as, but not limited to, CAT7 or CAT8) when the standards for such cables are finally determined.

The ability to alter the position of the T-spline (201) within the cable (100) to provide for a plurality of different arrangements provides for benefits in larger cables which are constructed from a plurality of data cables (100). These are referred to herein as "collected cables" One such embodiment of a collected cable is shown in FIG. 3.

Figure 3:
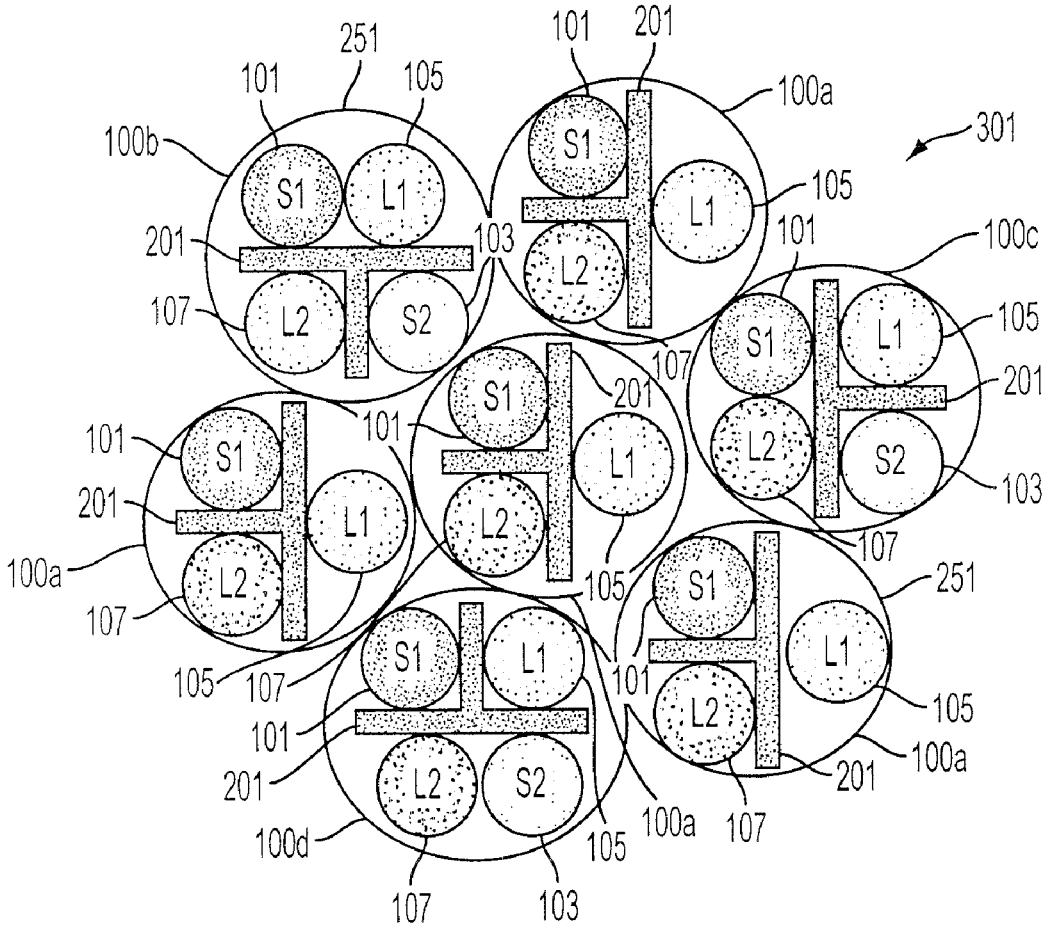
FIG. 3 provides a conceptual cut-through view of a 25 pair cable formed of a number of individual data cables using T-shaped splines.

In FIG. 3, a 25 pair cable (301) has been formed which comprises four different data cables (100*a*), (100*b*), (100*c*) and (100*d*), each of which comprises a plurality of component cables, a T-shaped spline (201) and a jacket (251). The cable (100*a*) comprises three component cables (101), (105), and (107), while the remaining cables (100*b*), (100*c*) and (100*d*) each comprise four component cables (101), (103), (105), and (107) and have the spline (201) positioned differently within each of those designs so as to provide sufficient separation between all pairs within the entire 25 pair cable (301) without use of extraneous separation material. Specifically, the 25 pair cable can utilize the separation created by the jackets (251) and physical spacing of the cables (100*a*), (100*b*), (100*c*), and (100*d*) within the 25 pair cable (301) to provide for separation sufficient to inhibit cross-talk, without need to use additional material.

One of ordinary skill in the art would understand that the 25 pair cable (301) of FIG. 3 is merely one arrangement in which a T-shaped spline (201) used as part of a data cable (100) can be used to provide for sufficient separation in collected cables (301) and larger cable constructs, and other designs with other numbers of data cables (100), component cables (101), (103), (105), and (107), or arrangements of the components can be constructed without undue experimentation.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A multi-part cable comprising:

four-component cables, each of said component cables having a different lay length; and a T-shaped spline having a longitudinal axis extending along the longitudinal axis of the cable; the spline comprising:

a main beam having a first side and a second side; and an auxiliary beam which extends from said first side of said main beam at or about the center of the main beam, and generally has a latitudinal dimension about one half the dimension of the main beam;

wherein the component cable having the longest lay length and the component cable having the second shortest lay length are placed on said first side of said main beam and are separated from each other by said auxiliary beam; and wherein the component cable having the shortest lay length and the component cable having the second longest lay length are arranged on said second side of said main beam and are not separated from each other by any portion of said spline.

2. The cable of claim 1 wherein said cable meets the criteria set out by one of the standards selected from the group of standards consisting of: category 5, category 5e, and category 6.

3. The cable of claim 1 wherein each of the component cables comprises a twisted pair of insulated conductors.

4. The cable of claim 3 wherein each of said twisted pairs of insulated conductors is a double helix.

5. The cable of claim 1 further comprising:

an insulative jacket enclosing the T-shaped filler and the component cables.

6. The cable of claim 5 further comprising:

a shield which also encloses said T-shaped filler and said component cables and is also enclosed by said insulative jacket.

7. The cable of claim 1 further comprising:

a shield which encloses said T-shaped filler and said component cables.

8. A multi-part cable comprising:

four twisted pair data cables each of which is formed of two intertwined individually insulated conductors having a longitudinal axis, each of said four twisted pair data cables having a different lay length;

a T-shaped filler having a generally T-shaped cross-sectional shape with three arms and a longitudinal axis; and an insulative jacket enclosing said data cables and said T-shaped filler along their longitudinal axes;

wherein two of said at least four cables are not separated by an arm of said T-shaped filler; and wherein said two cables not separated by an arm of said T-shaped filler are the cable having the shortest lay length, and the cable having the second longest lay length.

9. The cable of claim 8 wherein said cable meets the criteria set out by one of the standards selected from the group of standards consisting of: category 5, category 5e, and category 6.

10. A collected cable comprising:

a first multi-part cable comprising:

three component cables; and a T-shaped spline having a longitudinal axis extending along the longitudinal axis of the cable; the spline comprising:

a main beam; and an auxiliary beam which extends from one side of said main beam at or about the center of the main beam, and generally has a latitudinal dimension about one half the dimension of the main beam; and a second multi-part cable comprising:

four component cables; and a T-shaped spline having a longitudinal axis extending along the longitudinal axis of the cable; the spline comprising:

a main beam; and an auxiliary beam which extends from one side of said main beam at or about the center of the main beam, and generally has a latitudinal dimension about one half the dimension of the main beam;

wherein within said second multi-part cable:

each of said four component cables has a different lay length; and the component cable having the shortest lay length and the component cable having the second longest lay length are not separated from each other by any portion of said spline.

* * * * *